United States Patent [19]

Nakayasu et al.

[11] Patent Number: 5,071,275

[45] Date of Patent: Dec. 10, 1991

[54] PRINTER HAVING A BAIL ROLLER OPENING AND CLOSING MECHANISM

[75] Inventors: Hirofumi Nakayasu; Chikako Kawana; Masaki Kanoh, all of Kawasaki; Kenji Umehara, Kunitachi; Yoshiaki Hosokawa; Takashi Maekawa, both of Kawasaki, all of Japan

[73] Assignee: Fujitsu Limited, Kawasaki, Japan

[21] Appl. No.: 490,890

[22] Filed: Mar. 9, 1990

[30] Foreign Application Priority Data

| | | | |
|---|---|---|---|
| Mar. 10, 1989 | [JP] | Japan | 1-59444 |
| May 8, 1989 | [JP] | Japan | 1-114409 |
| May 8, 1989 | [JP] | Japan | 1-114410 |

[51] Int. Cl.[5] ..... B41J 13/20; B41J 11/36

[52] U.S. Cl. ..... 400/639.1

[58] Field of Search ..... 400/639, 639.1, 639.2, 400/638, 636.1, 637.1, 634

[56] References Cited

U.S. PATENT DOCUMENTS

| | | | |
|---|---|---|---|
| 4,569,611 | 2/1986 | Watanabe et al. | 400/639.1 |
| 4,647,239 | 3/1987 | Maezawa et al. | 400/639.1 |
| 4,707,159 | 11/1987 | Hirano et al. | 400/639.1 |
| 4,859,099 | 8/1989 | Kanemoto et al. | 400/636.1 |
| 4,883,375 | 11/1989 | Karube et al. | 400/639 |

FOREIGN PATENT DOCUMENTS

| | | | |
|---|---|---|---|
| 101841 | 3/1984 | European Pat. Off. . | |
| 216394 | 4/1987 | European Pat. Off. . | |
| 63-153170 | 6/1988 | Japan . | |
| 0170054 | 7/1988 | Japan | 400/639.1 |
| 2138785 | 10/1984 | United Kingdom . | |

OTHER PUBLICATIONS

"Paperfeed Apparatus", *IBM Technical Disclosure Bulletin,* vol. 22, No. 4, 9/79, pp. 1321-1322.

IBM Technical Disclosure Bulletin, vol. 4, No. 5, Sep. 1979, N.Y., U.S., pp. 677-678.

Patent Abstracts of Japan, vol. 12, No. 416, Nov. 4, 1988.

IBM Technical Disclosure Bulletin, vol. 23, No. 10, Mar. 1981, N.Y., U.S., pp. 4798-4799.

Patent Abstracts of Japan, vol. 12, No. 448, Nov. 24, 1988.

*Primary Examiner*—Eugene H. Eickholt

*Attorney, Agent, or Firm*—Armstrong, Nikaido, Marmelstein, Kubovcik & Murray

[57] ABSTRACT

A printer having a bail roller opening and closing apparatus including a bail roller for pressing a printing medium against a platen, a bail roller opening and closing mechanism for moving the bail roller between a closed position and an open position, and a clutch for connecting a space motor to the bail roller opening and closing mechanism. The bail roller opening and closing mechanism includes a rotating member rotationally driven by the space motor via the clutch, a transmission member causing the bail roller to be displaced by displacement of the transmission member and manual displacement of the bail roller, and a bidirectional motion transmission mechanism for transmitting bidirectional motion between the rotating member and the transmission member.

11 Claims, 20 Drawing Sheets

FIG. 9
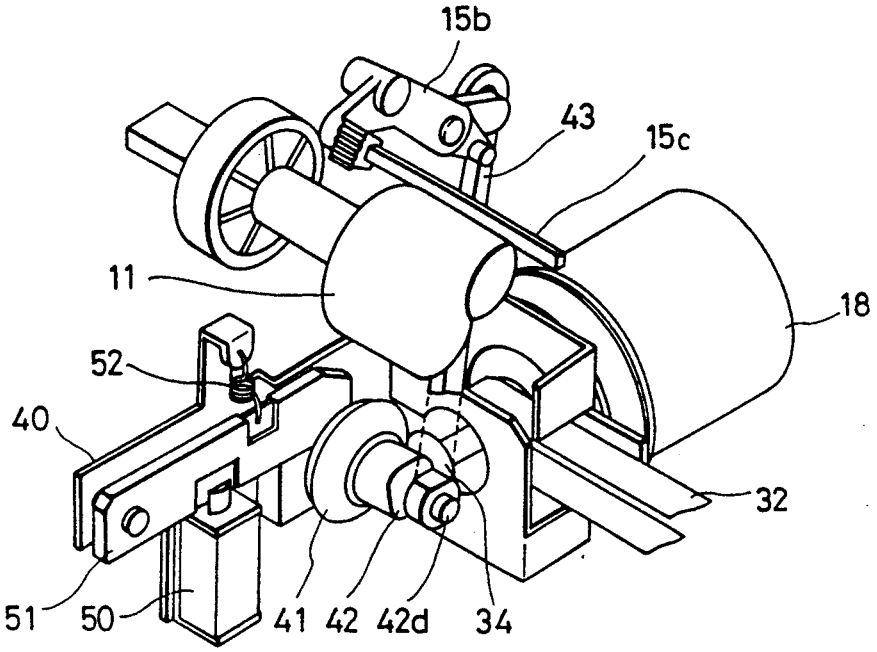
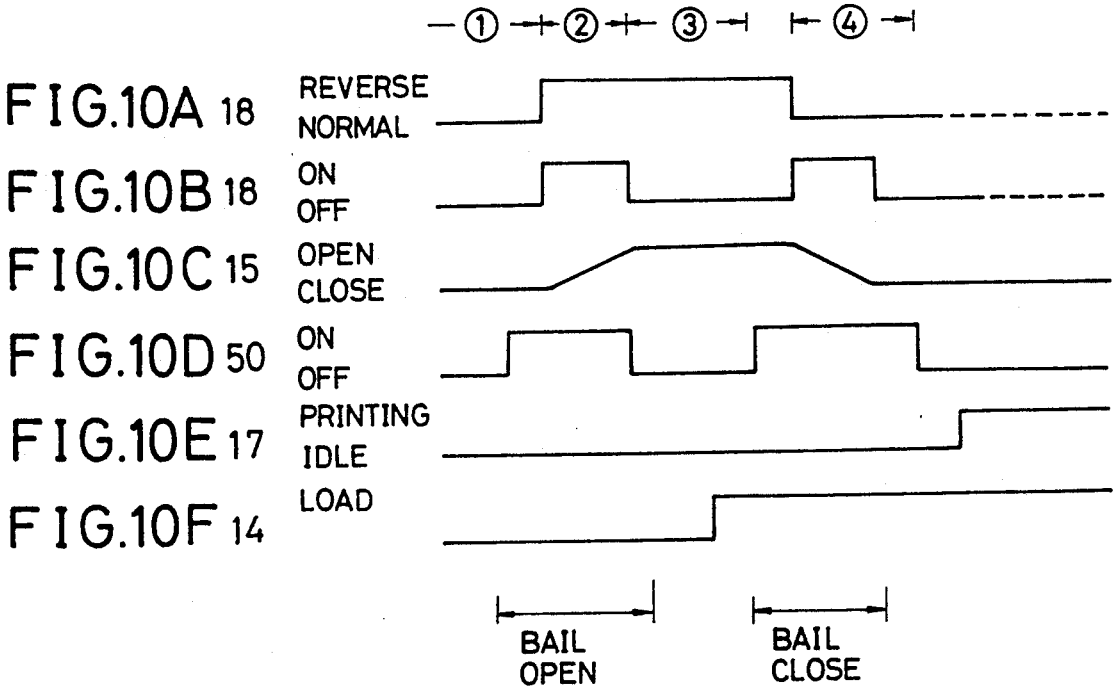

PRINTER HAVING A BAIL ROLLER OPENING AND CLOSING MECHANISM

BACKGROUND OF THE INVENTION

The present invention relates to a printer having a bail roller opening and closing mechanism.

Printers are provided with a bail roller in order to hold continuous paper or cut sheets and the like against the platen in the vicinity of the printing head so that favorable printing operation can be performed.

In recent years, automatic paper loading systems have been used, and accordingly printers have been required to provide bail roller opening and closing mechanisms to automatically shift the bail roller between a closed position where the bail roller is in contact with the platen and an open position where the bale roller is separated far from the platen.

These bail roller opening and closing mechanisms should desirably have a simple and highly reliable mechanism.

Conventionally, the motor for line feed is used as the drive power source for the opening and closing of the bail roller.

In mechanisms having this configuration, if bale roller opening and closing operation is performed while the paper is being loaded by the line feed motor, the load on the line feed motor changes while the paper is being loaded and discrepancies in the amount of line feed occur.

A bail roller opening and closing mechanism in which this problem has been eliminated is disclosed in Japanese Patent Laid Open Publication No. 63-153170. In this mechanism, the configuration is such that the space motor that moves the printing head is used as the drive power source to rotate a cam to rotate an arm having a bail roller at its distal end.

In this mechanism, because the space motor is used, there occurs no adverse influence to the operation for loading the paper while performing opening and closing operation for the bail roller.

In addition, so that it is possible to rectify paper jams and the like, the configuration of the bail roller opening and closing mechanism must be such that the bail roller in the closed position can be moved manually to the open position.

In the mechanism disclosed in Japanese Patent Laid Open Publication No. 63-153170, when the bail roller is pulled manually, the arm is rotated and the other end of the arm is separated from the cam surface of the cam. This is to say that the state where the cam and the arm have been in mechanical contact is cancelled. Accordingly, the cam enters the free state and there by can be easily rotated due to impact forces and the like.

If some impact force is applied to the printer while paper jam rectification is being carried out, and the cam then slips from its rotational position, there occurs some deviation between the actual rotational position of the cam and the predetermined rotational position of the cam, when the bail roller has been opened or closed. Because of this, the bail roller comes to be stopped before it reaches either the opened or the closed position, therefore preventing normal bail roller opening and closing operation from being carried out.

SUMMARY OF THE INVENTION

Accordingly, it is a general object of the present invention is provide a novel and useful printer having a bail roller opening and closing mechanism in which the problems described heretofore are eliminated.

Another object of the present invention is to provide a printer with a configuration whereby it is possible to maintain the mechanical relationship between the rotating member rotated by the space motor, and the medium that transfers this rotation of the rotating member to the bail roller, so that it is possible to have transmission of movement from the rotating member to the above medium and from the medium to the rotating member.

According to the present invention, the rotational position of the rotating and the position of the bale roller are always maintained in a predetermined relationship of correspondence. Accordingly, the opening and closing of the bail roller is performed with a high reliability.

Another object of the present invention is to provide a bail roller opening and closing mechanism having a configuration whereby the motor that rotates the rotating body is controlled so that it temporarily stops at a position prior to the end of the opening operation for the bail roller.

According to the present invention, the inertia force of the bail roller is reduced and the impact force when the bail roller comes into contact with the platen is reduced. Accordingly, the pressure applied to the pressure-sensitive paper is reduced up to a degree that no mark is made on the pressure-sensitive paper.

Still another object of the present invention is to provide a bail roller opening and closing mechanism having a configuration whereby the motor that rotates the rotating body is controlled so that it starts to rotate in the normal direction temporarily, after the closing operation for the bail roller has been completed.

According to the present invention, the opening operation of the clutch means provided in the transmission path leading from the motor to the rotating member described above is performed accurately.

Still another object of the present invention is to provide a bail roller opening and closing mechanism having a configuration whereby after the closing operation of the bail roller has been completed, the motor is controlled so that it starts to rotate in the normal direction and then to rotate in the reverse direction.

According to the present invention, even if a fingertip or the like is caught between the bail roller and the platen, the opening operation for the clutch means described above can be performed definitely.

Other objects and further features of the present invention will be apparent from the following detailed description when read in conjunction with the accompanying drawings

BRIEF DESCRIPTION OF THE DRAWINGS

FIG. 9 is a view indicating the closing operation for the bail roller;

FIG. 10A through 10F are timing charts for describing the opening operation and the closing operation for the bail roller;

DESCRIPTION OF THE PREFERRED EMBODIMENTS

Figure 1:
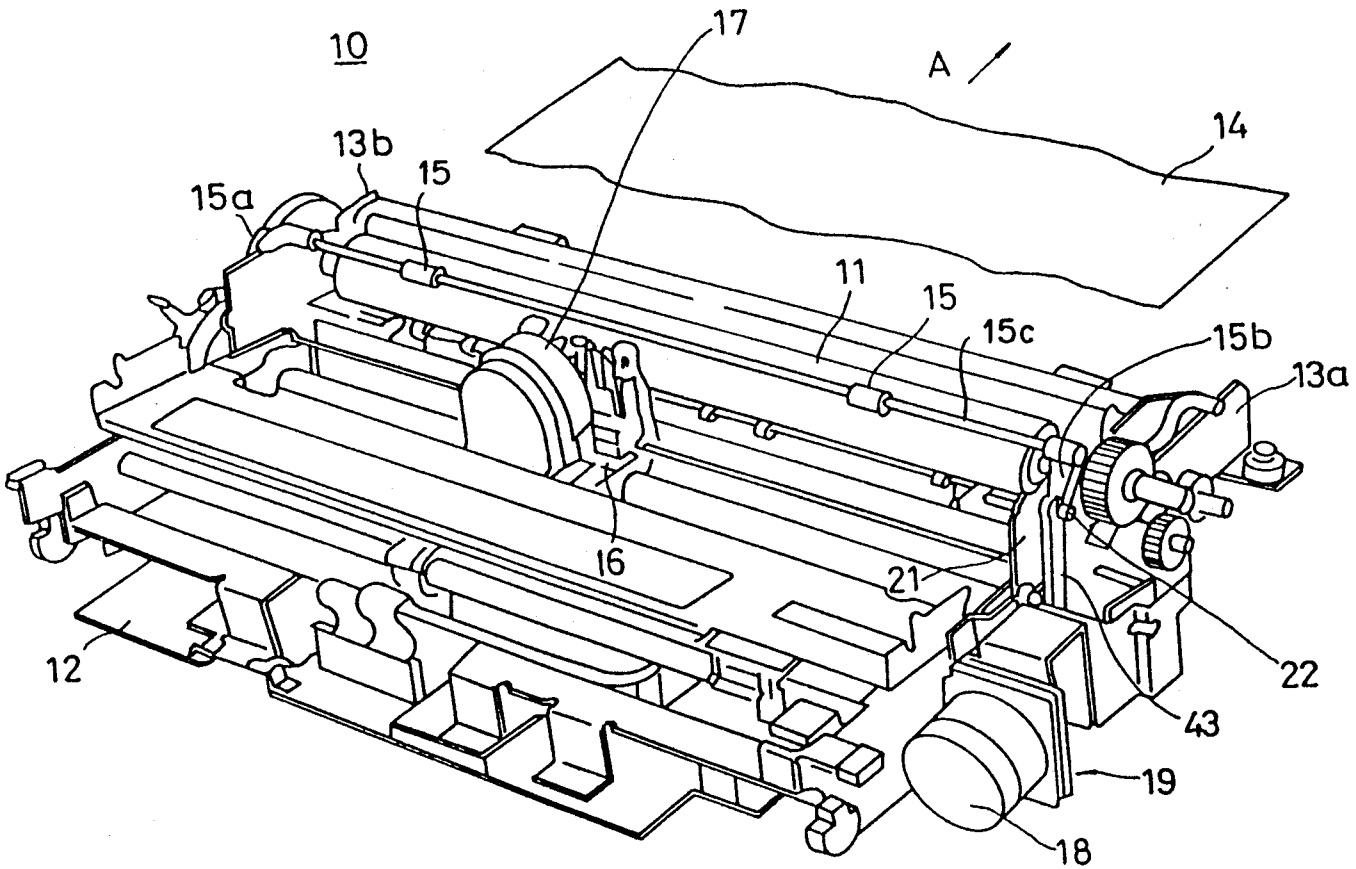
FIG. 1 is a perspective view of the mechanism portion of a printer of a first embodiment according to the present invention.

Referring to FIG. 1 showing a schematic configuration of a printer 10 according to the present invention, a platen 11 is provided between the right and left side plates 13*a* and 13*b* of a base unit 12, and is driven by a paper feed mechanism (not indicated in the figure) so that printed paper 14 is fed in the direction indicated by the arrow A.

A bail roller 15 is provided parallel to the platen 11 and holds the paper 14 against the platen 11.

A carrier unit 16 supports the printing head 17 and is moved reciprocally along the longitudinal direction of the platen 11 by means of a mechanism 19 that includes a space motor 18.

Figure 2:
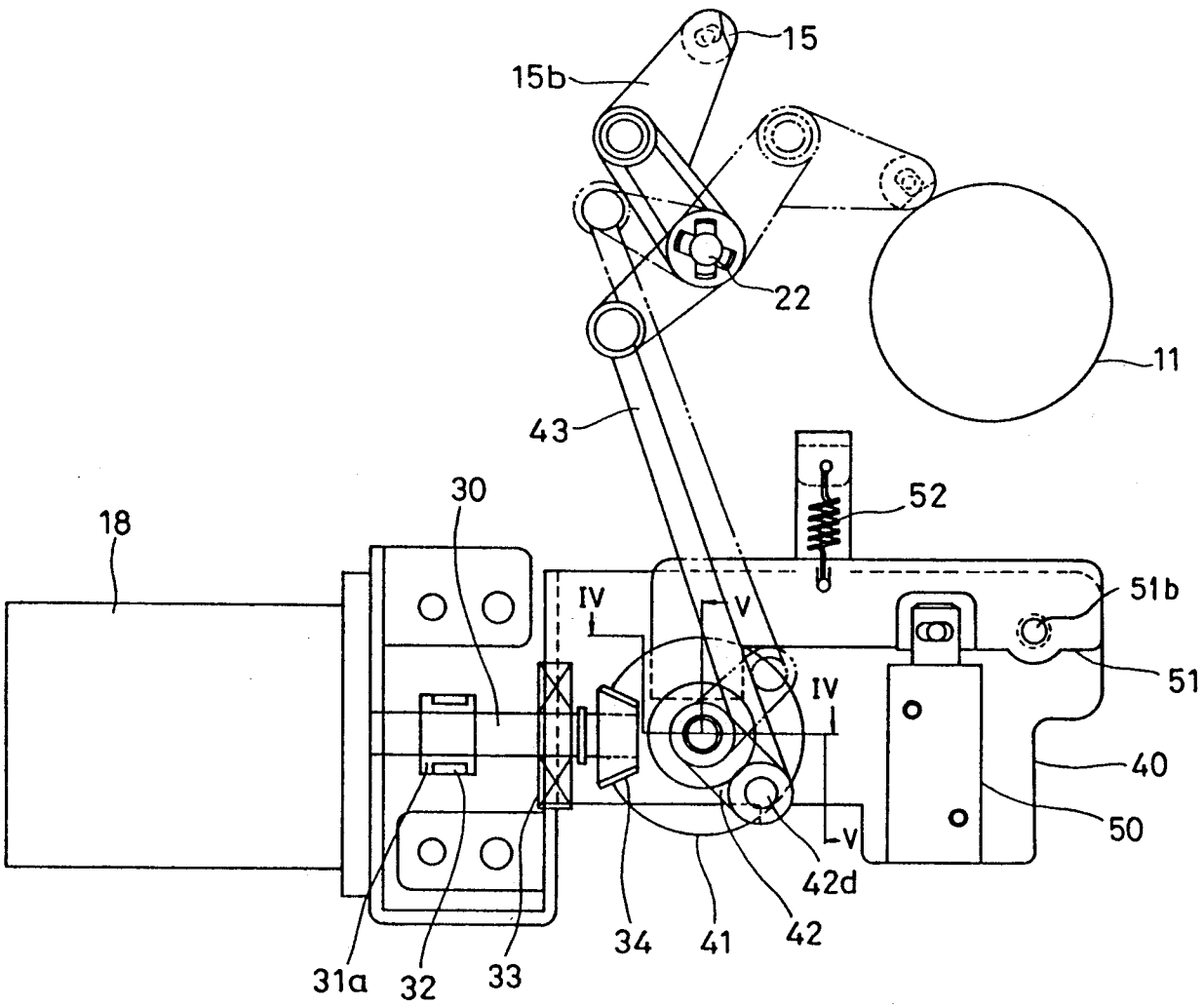
FIG. 2 is a side elevational view of the bail roller opening and, closing mechanism of FIG. 1.
Figure 3:
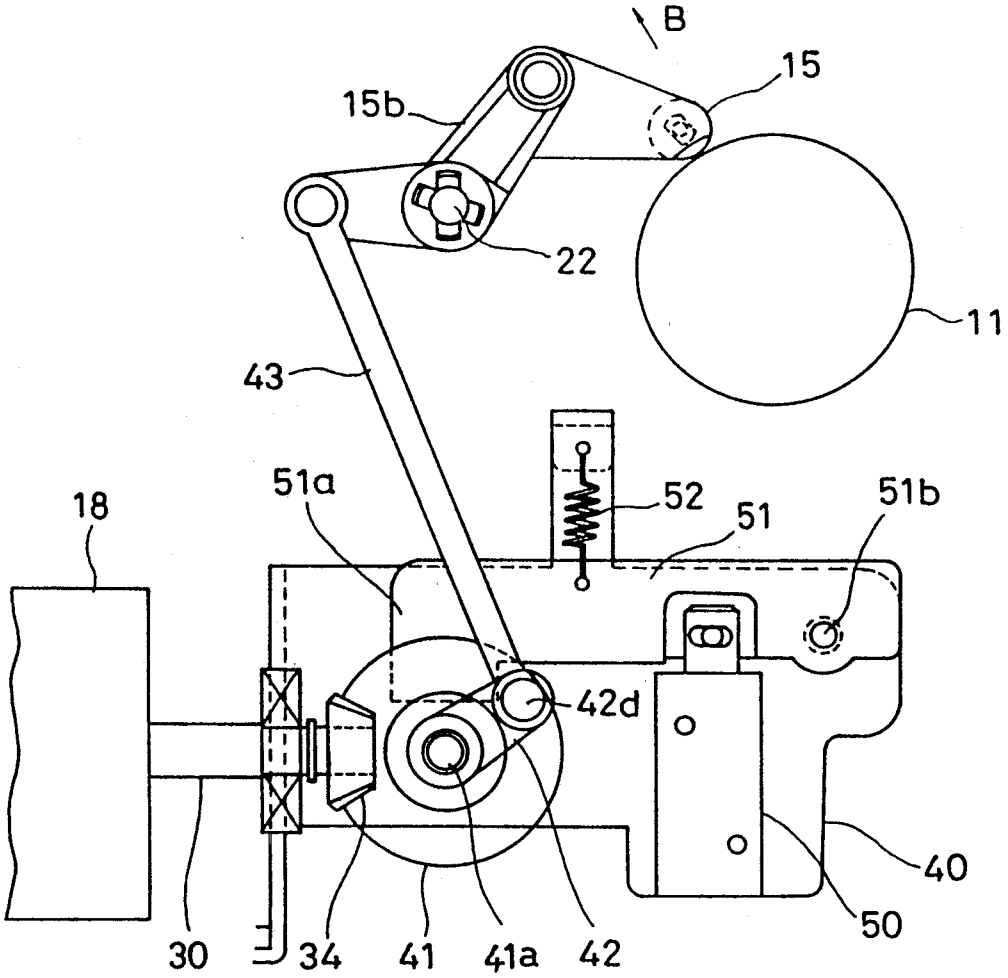
FIG. 3 is a side elevational view indicating the state where the bail roller is closed.
Figure 6:
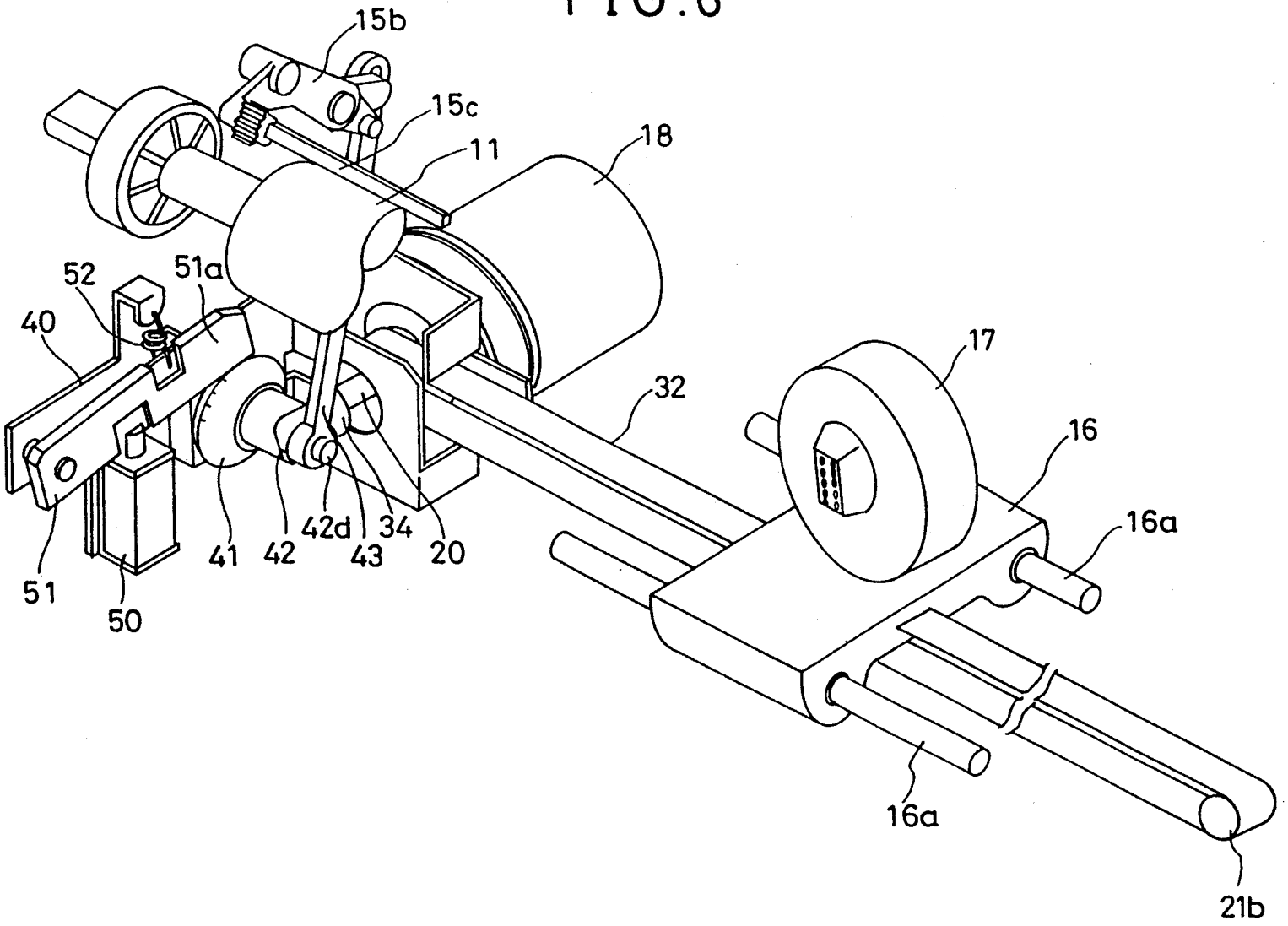
FIG. 6 is a perspective view of the bail roller opening and closing mechanism.

In FIG. 2, 3 and 6, the shaft 30 of the space motor 18 is provided with a pulley 31*a*. Between this pulley 31*a* and another pulley 31*b*, is arranged an endless timing belt 32.

This timing belt 32 is connected to the carrier unit 16. When the space motor 18 is driven, the timing belt 32 moves so that the carrier unit 16 moves along the pair of guides 16*a*.

The shaft 30 of the space motor 18 is supported by a bearing 33 on a bracket 40. This bracket 40 is fixed in the side plate 13*a*. At a distal end of the shaft 30 is fixed a bevel gear 34.

Figure 4:
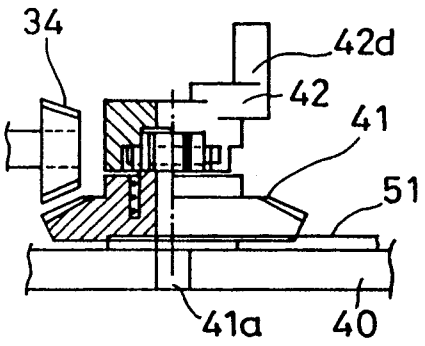
FIG. 4 is a view in partial cross section along the line IV—IV of FIG. 2.
Figure 5:
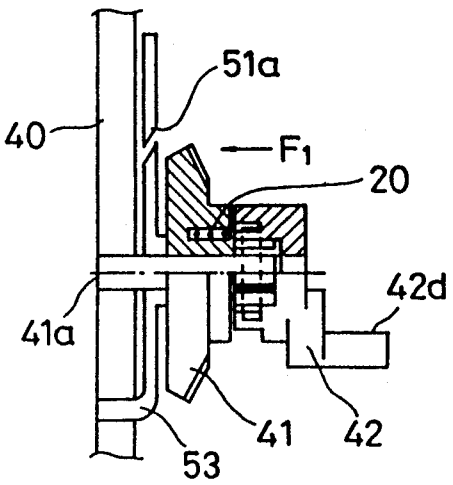
FIG. 5 is a view in partial cross section along the line V-V of FIG. 2.

In addition, as indicated in FIG. 4 and FIG. 5, on a shaft 41*a* fixed to the bracket 40 is provided a bevel gear 41 such that it is rotatable and movable in the direction of the shaft 41*a*. In addition, a crank 42 is provided on the shaft 41*a* in a manner such that rotation is allowed but displacement along the shaft 41*a* is restricted.

In principle, the bevel gear 41 and the crank 42 rotate together.

A compression coil spring 20 is provided between the bevel gear 41 and the crank 42 to exert a force $F_1$ on the bevel gear 41 towards the bracket 40.

A bail arm 15*b* is supported on a shaft 22 on a bracket 21 (refer to FIG. 1) fixed to the side plate 13*a*. A bail arm 15*a* is provided to the opposite side plate 13*b* (refer to FIG. 1). The bail roller 15 is provided between the distal ends of the bail arms 15*a* and 15*b*.

The other end of the bail arm 15*b* and the crank 42 are linked by a connecting rod 43.

The crank 42 and the connecting rod 43 are linked by a pin 42*d*.

The bracket 40 is provided with a clutch lever 51 that pivots around a pivot 51*b*, a solenoid magnet 50 that drives the clutch lever 51, a coil spring 52 that urges the clutch lever 51 to the return position, and a shift member 53 to shift the bevel gear 41.

The distal end 51*a* of the clutch lever 51 is formed with an inclined surface as indicated in FIG. 5. The clutch lever 51 is urged in the downwards direction in FIG. 5 by the operation of the solenoid magnet 50, and the distal end 51*a* thereof is pushed to insert between the bracket 40 and the shift member 53, and moves the shift member 53 to the right direction in FIG. 5. The shift member 53 presses the center portion of the bevel gear 41 and shifts it to the right direction in FIG. 5, and the bevel gear 41 engages with the bevel gear 34.

The following is a description of the operation of the mechanism described above.

(1) In the normal state, as indicated in FIG. 10D and FIG. 6, the solenoid magnet 50 is off and the bevel gear 41 and the bevel gear 34 are not engaged. In addition, as indicated iu FIG. 10B, the space motor 18 is off, and the bail roller 15 is in the closed state.

Figure 7:
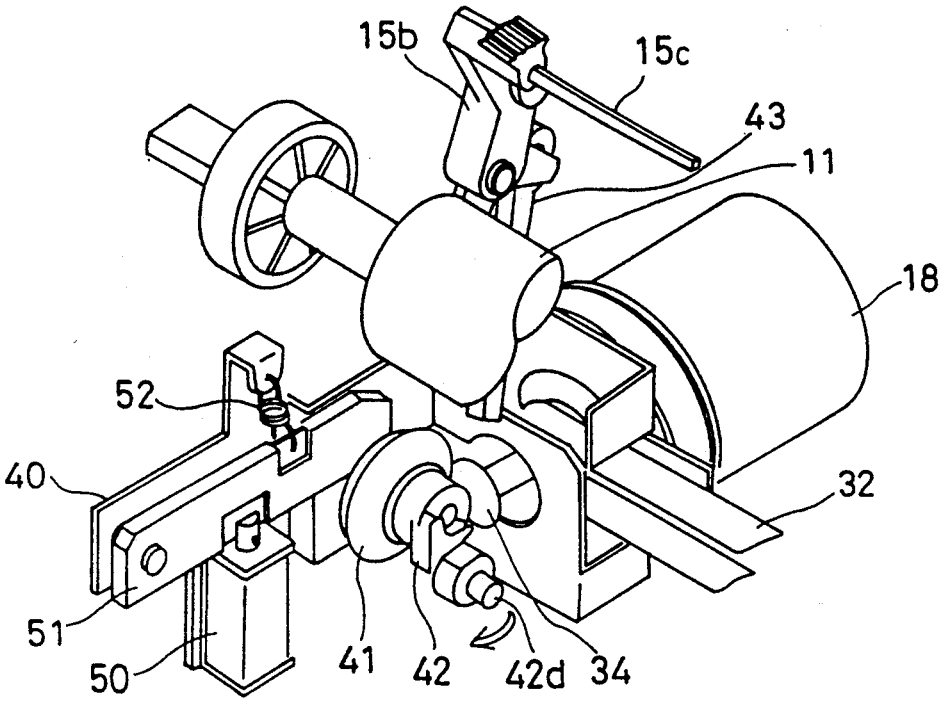
FIG. 7 is a detailed view indicating the bail roller opening operation.

(2) If a paper load occurs, then prior to the load, the solenoid magnet 50 turns on and the clutch lever 51 causes the bevel gear 41 to shift and thereby to engage with the bevel gear 34, as indicated in FIG. 10D and FIG. 7.

Figure 21:
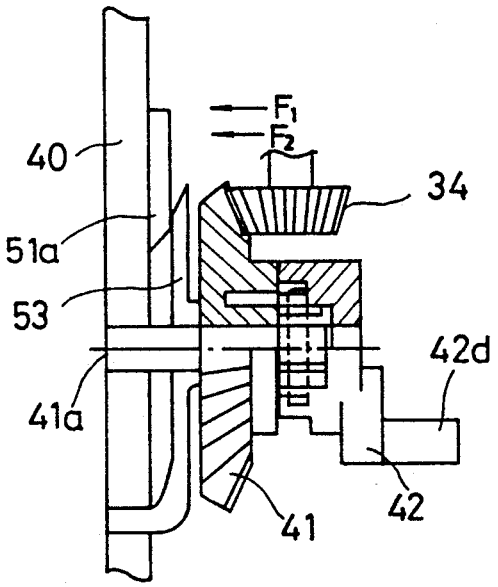
FIG. 21 is a view indicating the state where the bevel gears are meshing.
Figure 23:
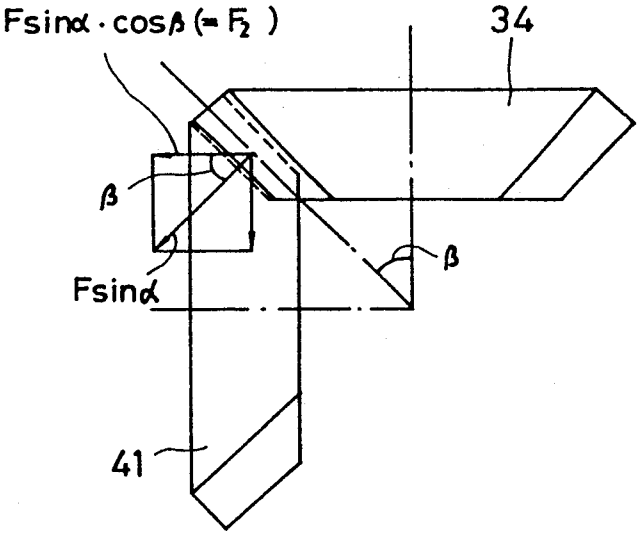
FIG. 22 and 23 are diagrams describing the generation of a thrust force on a bevel gear.

Since the shift member 53 causes the bevel gear 41 to shift, the bevel gear 41 is shifted horizontally indicated in FIG. 5 and FIG. 21 and so that there occurs no inclination in the bevel gear 41.

Then, as indicated in FIG. 10A and 10B, the space motor 18 starts to rotate in the reverse direction for a predetermined amount of time.

Accordingly, as indicated in FIG. 7, this reverse rotation of the space motor 18 rotates the crank 42 via the bevel gear 41 and bevel gear 34, and rotates the bail arm 15*b* via the connecting rod 43, and the bail roller 15 becomes the open state (refer to FIG. 10C).

Figure 8:
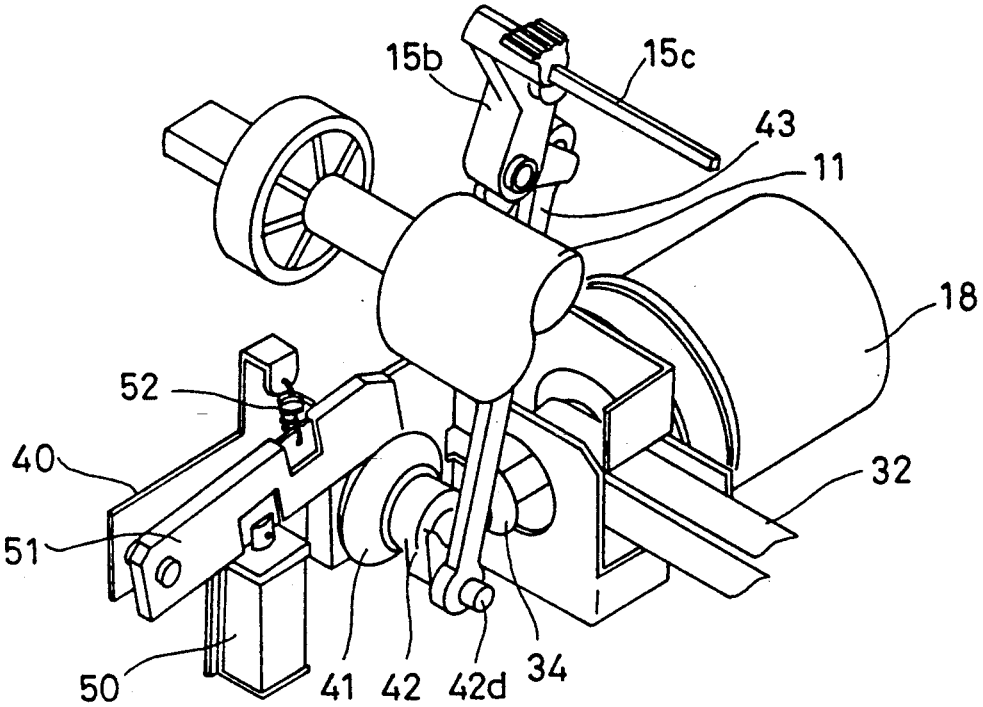
FIG. 8 is a view indicating the state where the opening operation of the bail roller has been completed.

(3) Then, as shown in FIG. 8, the rotation of the space motor 18 stops and the solenoid magnet 50 turns off. Accordingly, as indicated in FIG. 8, the meshed engagement of the bevel gear 41 and the bevel gear 34 is disengaged and the bail roller 15 is held in the open state by a spring (not indicated in the figure).

When the bail roller 15 becomes open, the paper is loaded as indicated in FIG. 10F.

(4) When the loading of the paper is completed, then, as indicated in FIG. 9 and 10D, the solenoid magnet 50 turns on once again and the clutch lever 51 causes the bevel gear 41 and the bevel gear 34 to engage and then the space motor 18 starts to rotate in the normal direction.

Accordingly, as indicated in FIG. 9, the space motor 18 rotates the crank 42 via the bevel gear 34 and the bevel gear 41, and rotates the bail arm 15*b* via the connecting rod 43 so that the bail roller 15 comes to the closed state.

Then, as indicated in FIG. 10B and 10D, the space motor 18 turns off, the solenoid magnet 50 also turns off and the engagement of the bevel gear 34 and the bevel gear 41 is disengaged. The state indicated in FIG. 6 is established again, and the open/close operation is completed and printing commences.

During this time, the space motor 18 moves the printing head 17 along the platen 11, but this presents no problem because it is before the commencement of printing.

Also, following this, the solenoid magnet 50 is kept deenergized and the bevel gear 41 and the bevel gear 34 are held disengaged. Because of this, the bail roller 15 does not open or close even if the space motor 18 moves the printing head 17 for spacing movement.

The following is a description of the operation when the bail roller 15 in the closed position is manually pulled and moved to the open position whereupon paper jam rectification or the like is to be performed.

In the state indicated in FIG. 3, pulling the bail roller 15 in the direction of the arrow B causes the bail arm 15*b* to rotate in the counterclockwise direction and move the bail roller 15 to the open position indicated in FIG. 2.

The rotation of the bail arm 15*b* is transmitted to the crank 42 via the connecting rod 43 and the crank 42 rotates together with the bevel gear 41 in the clockwise direction.

Since the bevel gear 41 and the bevel gear 34 are not engaged, the rotation of the bevel gear 41 is not transmitted to the bevel gear 34 and the bail roller 15 can be opened with only a small operating force.

In the state where the bail roller 15 has attained to the open position, the connecting rod 43 and the crank 42 are still linked and so the rotation of the bevel gear 41 independent of the bail arm 15*b* is restricted, and the bevel gear 41 and the bail arm 15*b* do not rotate independently of each other even if an impact force is applied to the printer.

Accordingly, the rotational position of the bevel gear 41 and the rotational position of the bail arm 15*b* are always held in a predetermined relationship of correspondence and the automatic opening and closing operation of the bail roller 15 is performed reliably.

The following is a description of other embodiments according to the present invention, with reference to FIG. 11 through 15B.

In each of the figures, those parts which correspond to similar portions in FIG. 1 through 9 are indicated with the same numbers, and the corresponding description of them is omitted.

Figure 11:
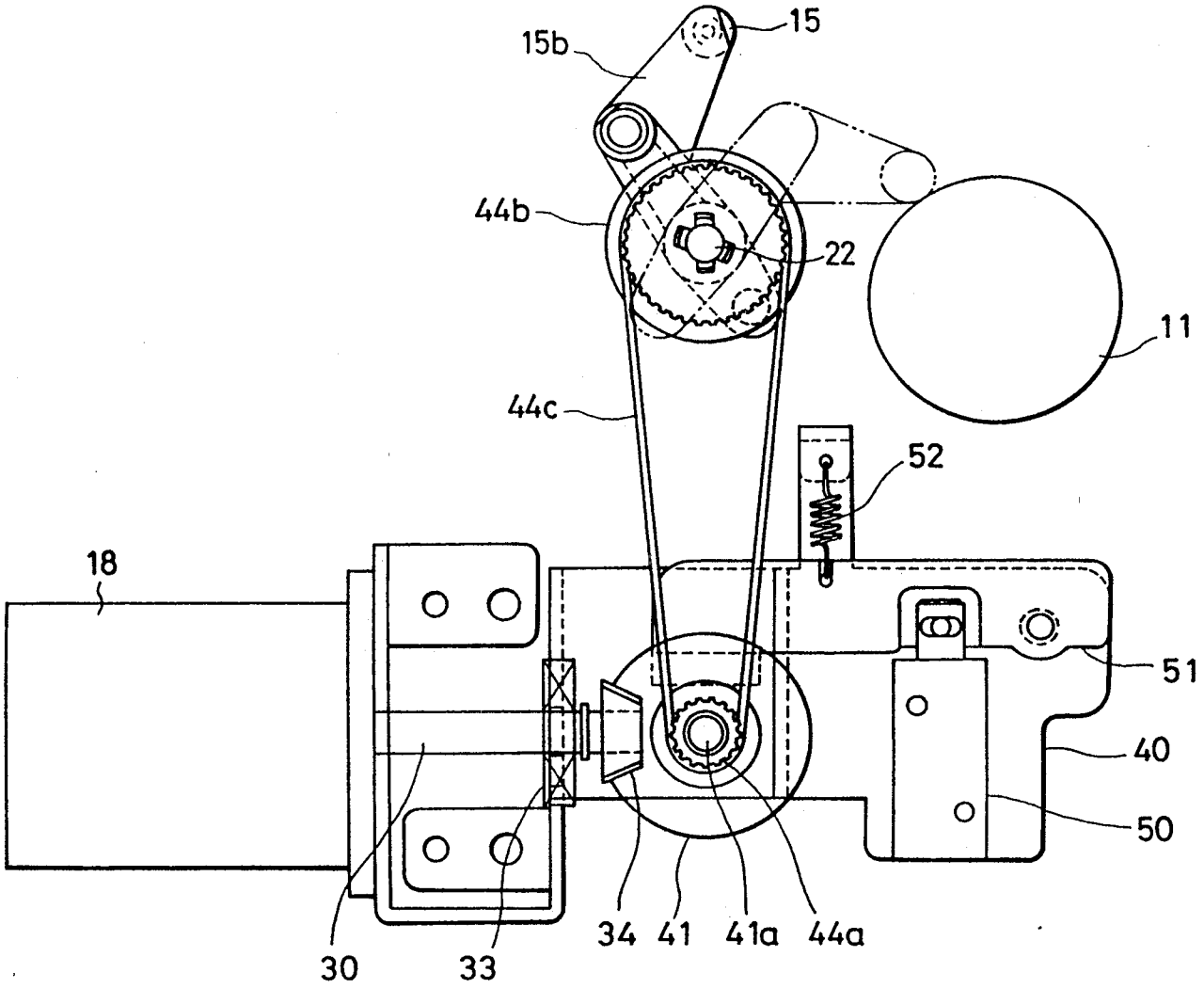
FIG. 11 is a side elevational view of a second embodiment of a printer according to the present invention.

FIG. 11 indicates a second embodiment according to the present invention.

A timing gear 44*a* is provided monolithically with the bevel gear 41 and another timing gear 44*b* is provided monolithically with the bail arm 15*b*. A timing belt 44*c* is arranged between the timing gear 44*a* and the timing gear 44*b*.

Figure 12:
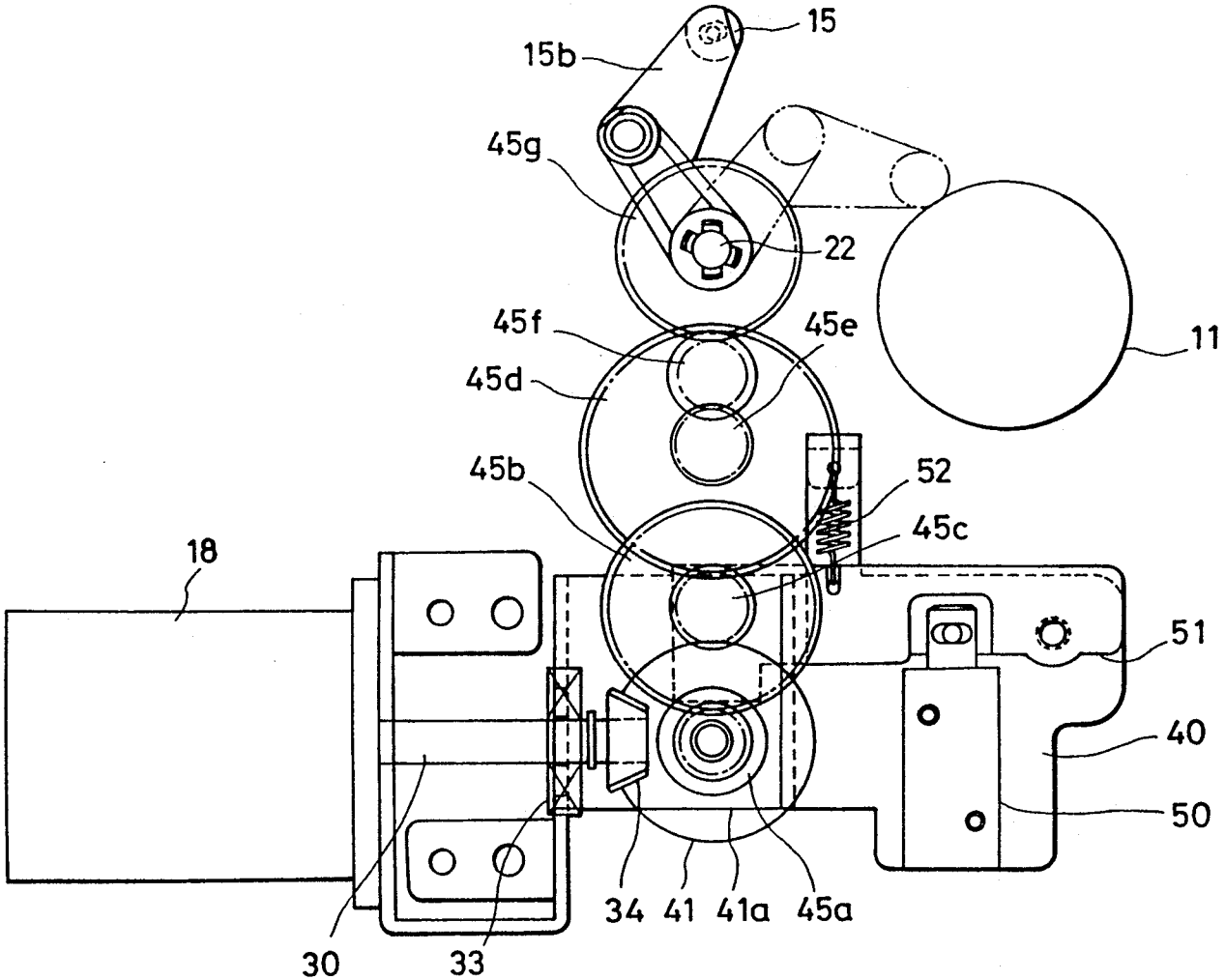
FIG. 12 is a side elevational view a third embodiment according to the present invention.

FIG. 12 is a third embodiment according to the present invention.

A gear 45*a* is provided monolithically with the bevel gear 41 and a gear 45*g* is provided monolithically with the bail arm 15*b*. Between the gears 45*a* and 45*g* is provided a gear train comprising gears 45*b* through 45*f*.

Figure 13:
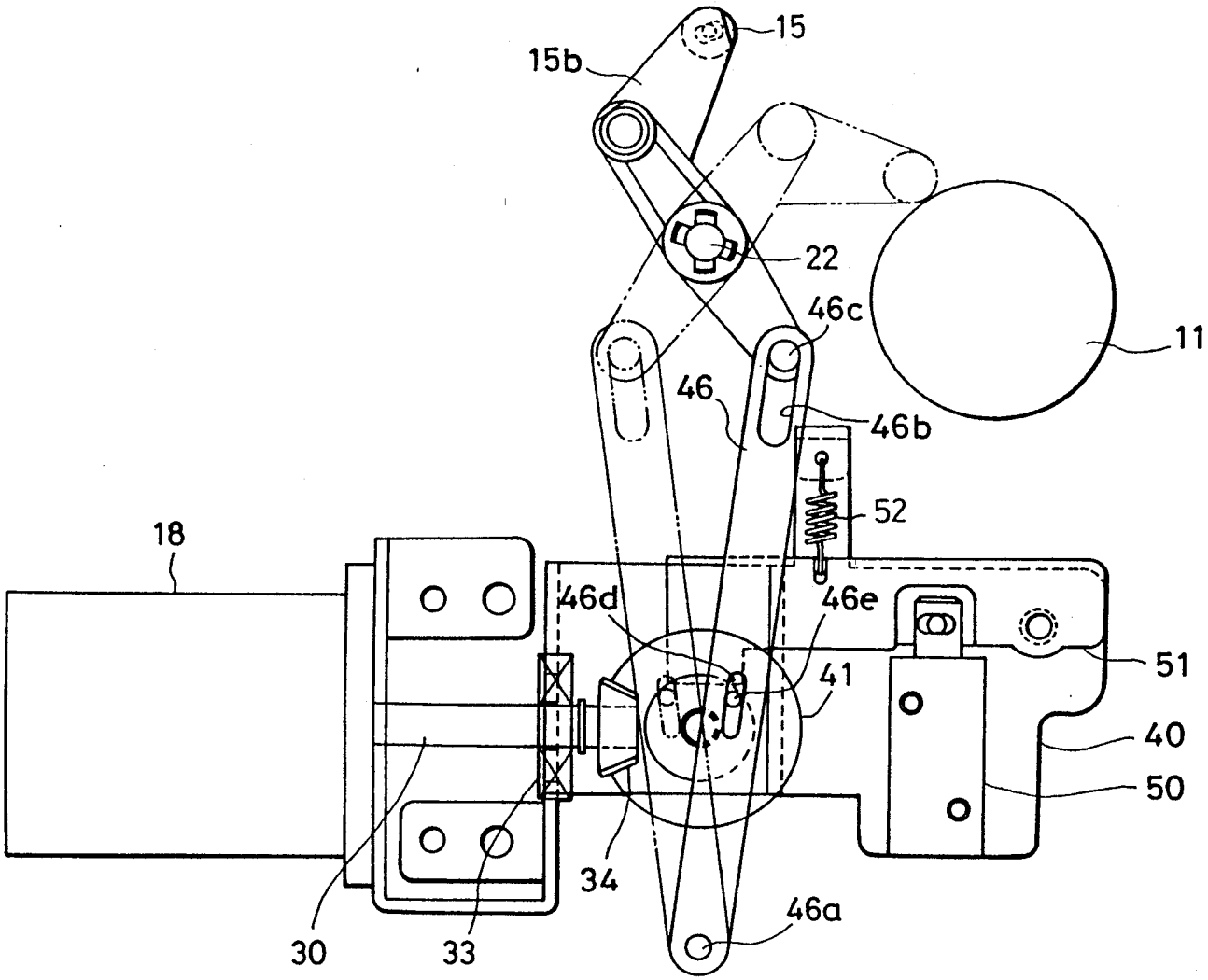
FIG. 13 is a side elevational view a fourth embodiment according to the present invention.

FIG. 13 indicates a fourth embodiment according to the present invention.

A rotating arm 46 is supported at a lower end thereof by a pin 46*a* and a slot 46*b* at the upper end thereof is in engagement with a pin 46*c* on the rear end of the bail arm 15*b*.

A slot 46*d* disposed midway along the rotating arm 46 is in engagement with a pin 46*e* fixed to the bevel gear 41.

Figure 14:
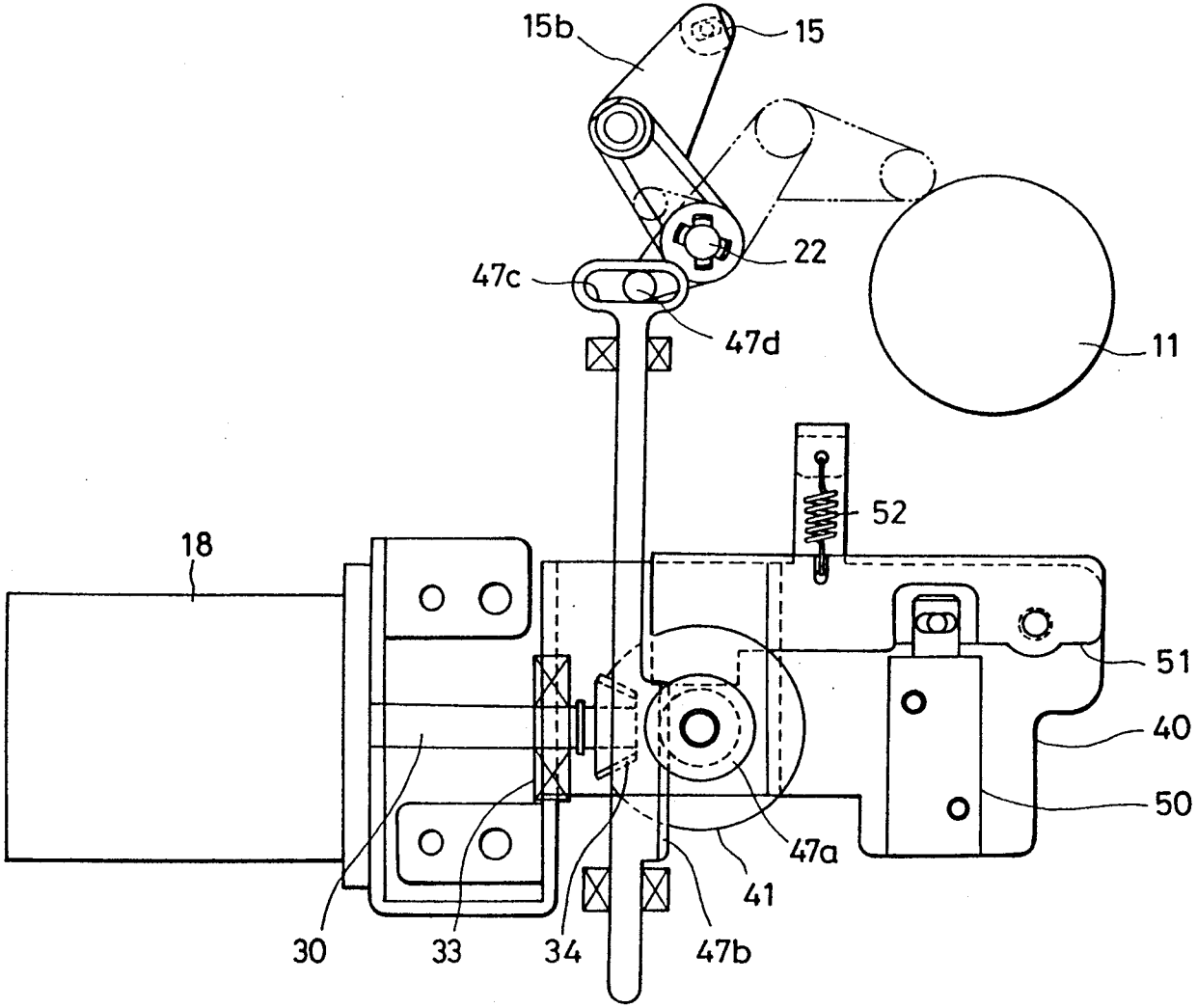
FIG. 14 is a side elevational view of a fifth embodiment according to the present invention.

FIG. 14 indicates a fifth embodiment according to the present invention.

A pinion 47*a* is provided monolithically with the bevel gear 41. A rack 47*b* meshes with the pinion 47*a* and is movable in the up and down direction. A slot 47*c* at the upper end of the rack 47*b* is in engagement with a pin 47*d* on the bail arm 15*b*.

Figure 15B:
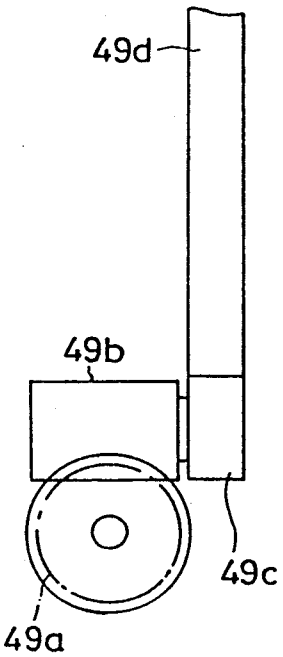
FIG. 15A and 15B are elevational views of a sixth embodiment according to the present invention.
Figure 15A:
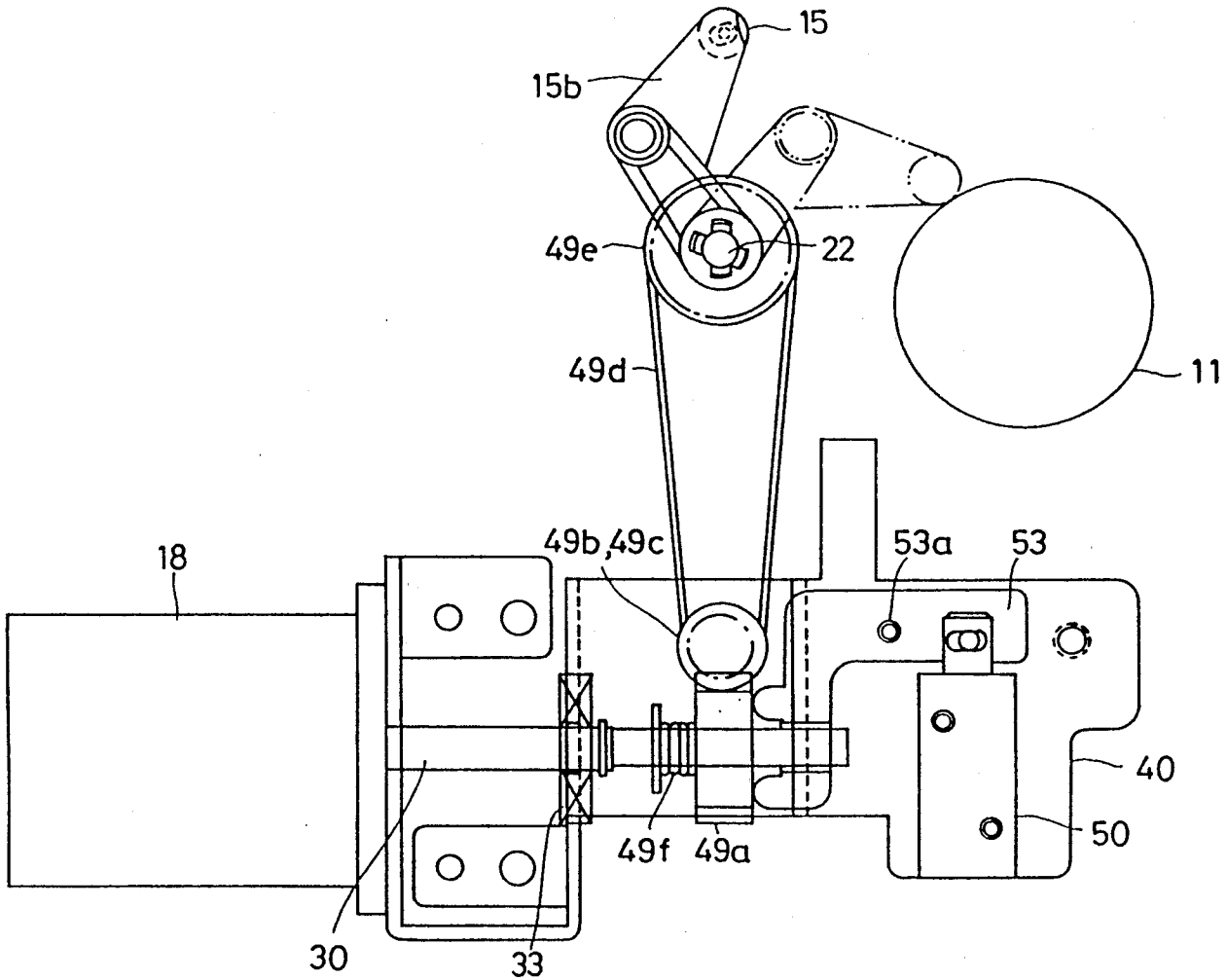
Figure 16A:
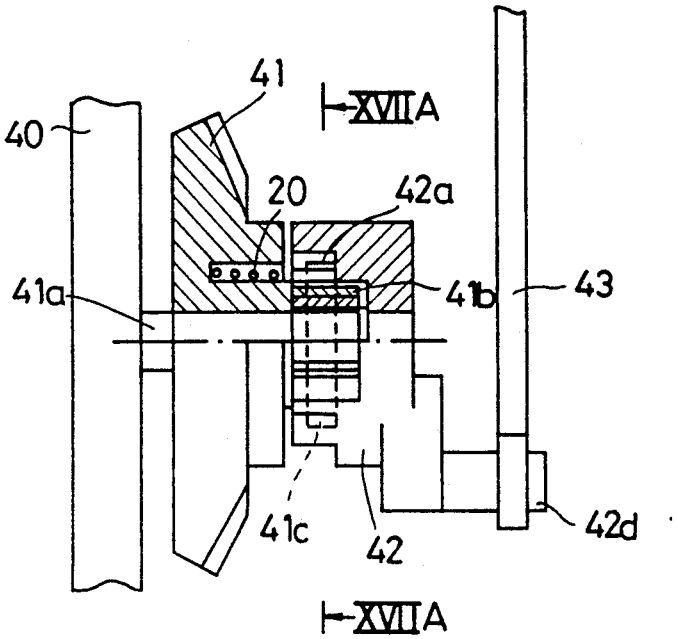
FIG. 16A is a enlarged view of the torque limiter between the bevel gear and the crank.
Figure 16B:
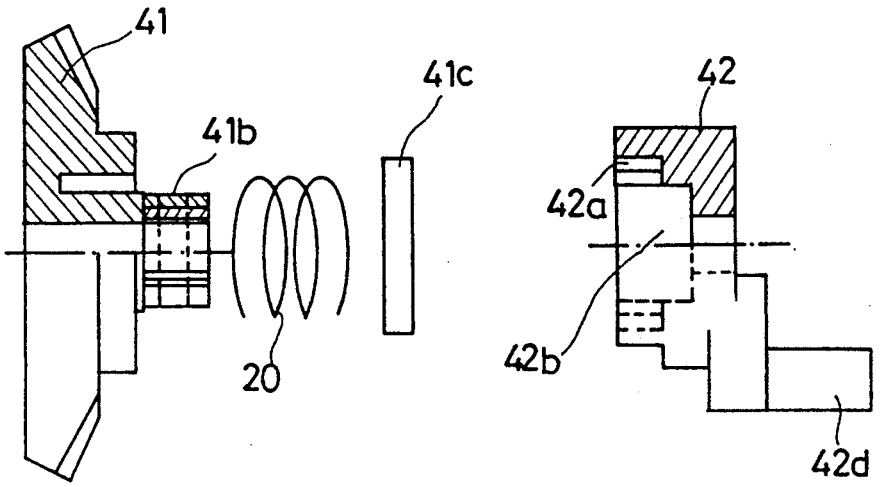
FIG. 16B is an exploded view indicating the torque limiter of FIG. 16A.

FIG. 15A and 15B indicate a sixth embodiment according to the present invention.

A spur gear 49*a* is slidably provided on the shaft 30 of the space motor 18. A clutch lever 53 is supported by the pin 53*a* and one end thereof is in contact with the spur gear 49*a*.

A worm 49*b* is in meshed engagement with the spur gear 49*a*. A pulley 49*c* is provided monolithically with the worm 49*b*.

In addition, a pulley 49*e* is also provided monolithically with the bail arm 15*b*.

A belt 49*d* is spanned between the pulley 49*c* and the pulley 49*e*.

When the solenoid magnet 50 is being off, the spring 49*f* causes spur gear 49*a* to shift in the right direction in FIG. 15A and the engagement with the worm 49*b* is disengaged.

FIG. 16A through FIG. 17B indicated a configuration where a torque limiter is provided between the bevel gear 41 and a crank 42.

The bevel gear 41 is provided with a protrusion 41*b*, and the crank 42 is provided with an indentation 42*b* corresponding to the protrusion 41*b*.

Figure 17A:
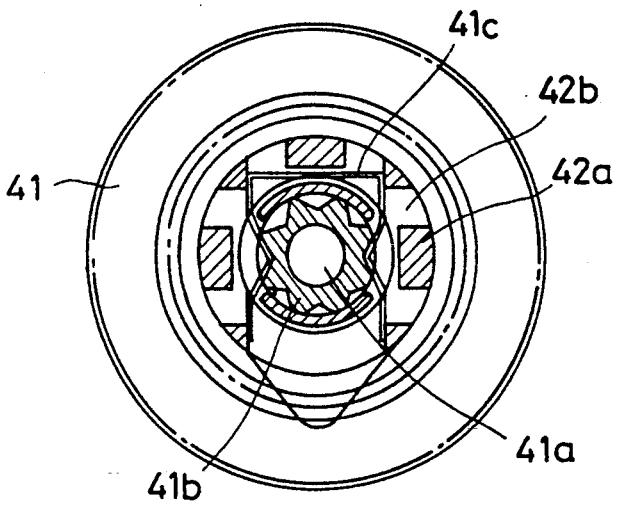
FIG. 17A is a sectional view taken along the line XVII—XVII of FIG. 16B.

The protrusion 41*b* of the bevel gear 41 has eight triangular-shaped protrusions around its periphery as indicated in FIG. 17A.

The indentation 42*b* of the crank 42 has seven protrusions around its periphery as indicated in FIG. 17A.

Then, as indicated in FIG. 17A, an U-shaped leaf spring 41*c* having a shape that engages with the triangular protrusion 41*b* of the bevel gear 41 is inserted between the protrusion 41b of the bevel gear 41 and the indentation 42a of the crank 42.

Accordingly, in the normal state, the triangular protrusion 41b of the bevel gear 41 and the leaf spring 41c are in engagement, which enable the drive force to be transmitted to the crank 42.

Figure 17B:
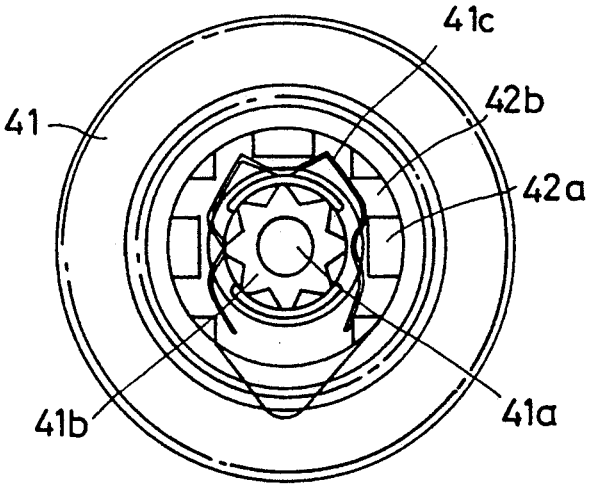
FIG. 17B is a view indicating the state when the torque limiter is operating.

When an excessive load is applied to the crank 42, the leaf spring 41c deforms, as indicated in FIG. 17B, to be disengaged from protrusion 41b of the bevel gear 41, and the bevel gear 41 rotates independent of the crank 42 so that the transmission of the drive power is interrupted.

The significance of providing this torque limiter is as described below.

First, the bail roller 15 is disposed in the area accessibly by the operator. If the bail roller 15 is touched by the operator while automatic opening and closing operation of the bail roller 15 is being performed, then this will apply an overload force to the system for the transmission of the drive force.

Also, an overload may be applied to the bail roller in the case where a part of the cover of a cassette sheet feeder interferes with the belt shaft when loading the cassette sheet feeder.

Furthermore, if the control amount is large when the bail roller is closed, then the paper may be pressed too hard to produce marks on the paper.

Because of this, the torque limiter is provided so that when an excessive force is applied to the bail roller while bail roller opening and closing operation is performed, the transmission of the drive force is interrupted so that damage to the mechanism and the leaving of marks on the copy paper are prevented.

In this embodiment, it is possible to easily realize a torque limiter by a configuration using the leaf spring 41c.

The following is a description of a seventh embodiment according to the present invention.

Figure 18:
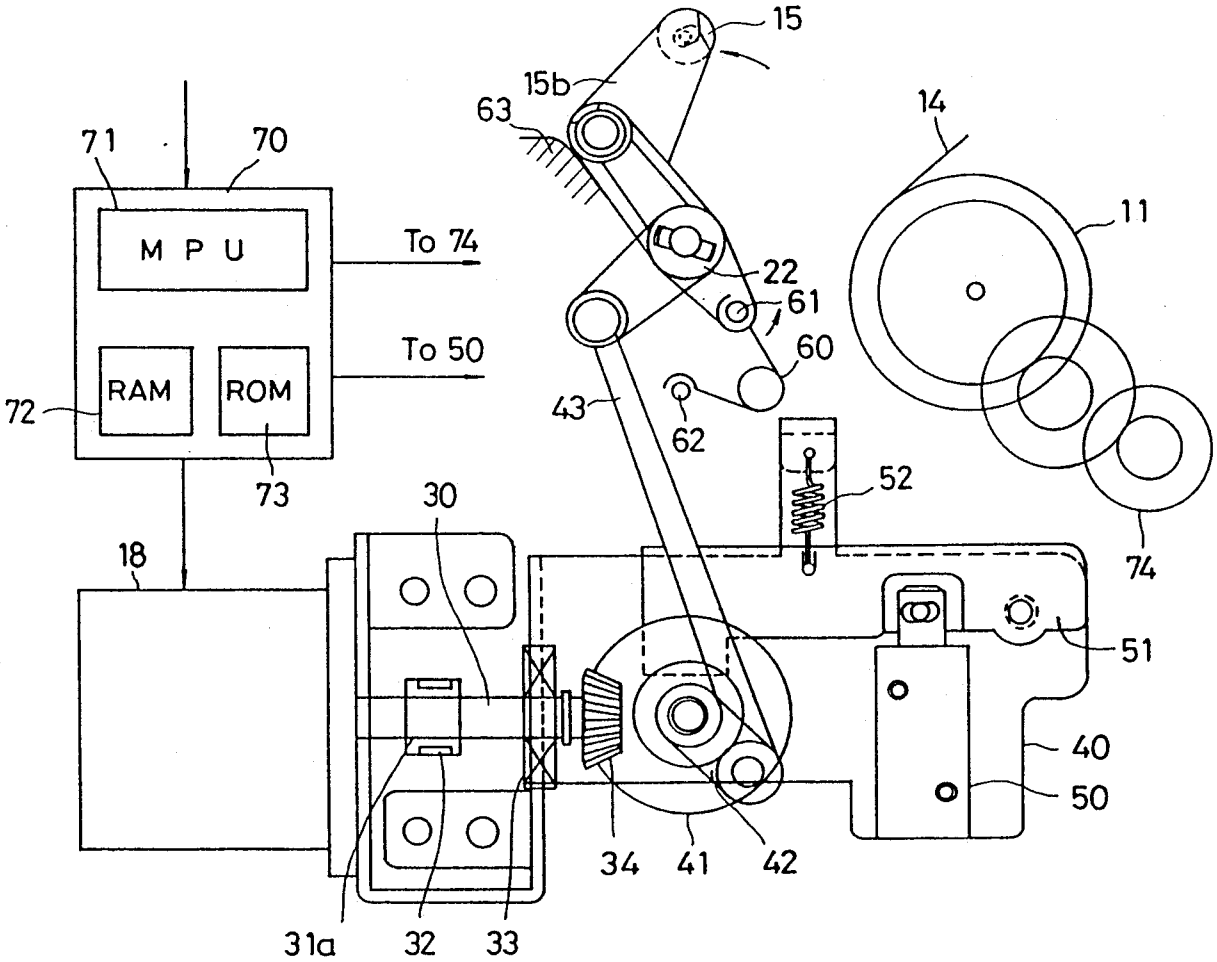
FIG. 18 is a side elevational view of a seventh embodiment of a printer according to the present invention.
Figure 19:
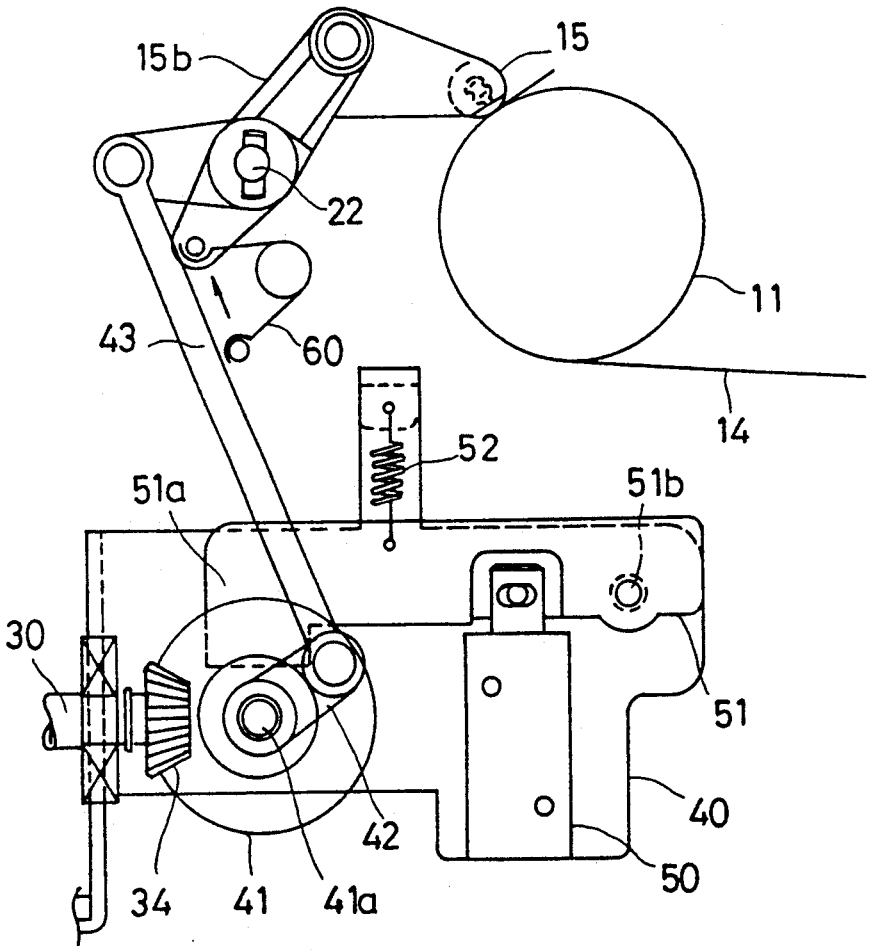
FIG. 19 is a view indicating the state where the bail roller is closed.

FIG. 18 indicates a seventh embodiment of a printer according to the present invention, and FIG. 19 indicates the state where the bail roller is closed. In each of the figures, those parts which correspond to similar portions in FIG. 2 though 3 are indicated with the same numbers, and the corresponding description of them is omitted.

A torsion spring 60 is provided so that one arm engages with a pin at the end of the bail arm 15b, and the other arm is in engagement with a pin 62 on a flange 21 (refer to FIG. 1).

This torsion spring 60 has a dead point at a position midway between the opening and closing positions of a bail roller 15. When the bail roller, 15 is closed (the state indicated in FIG. 19), the bail roller 15 is urged to press against the platen 11, and when the bail roller 15 is open (the state indicated in FIG. 18), the bail roller 15 is urged to press against the stopper 63. The spring force of the torsion spring 60 is such that the force by which is presses against the bail roller 15 is approximately 140 gm in the state indicated in FIG. 19

In FIG. 18, a control portion 70 comprises a microprocessor (MPU) 71, a RAM 72 and a ROM 73, and the like. According to input signals supplied from an operating panel of the printer or a host machine or the like, the control signals are generated and fed to the circuits for driving a line feed motor 74, the space motor 18 and the solenoid magnet 50 and the like.

The following is a description of the operation of a device having the above configuration.

The description is omitted for that portion of the operation which is the same as the operation described for the embodiments indicated in FIG. 2 and 3.

(1) The operation for the opening of the bail roller 15 is the same as that for the previous embodiments, inasmuch as the solenoid magnet 50 is turned on (refer to FIG. 20A) and, as indicated in FIG. 21, the distal end portion 51a of the clutch lever 51 is inserted between the bracket 40 and the shift member 43, the bevel gear 41 engages with the bevel gear 34 (refer to FIG. 20B) and the space motor 18 starts to rotate in the normal direction.

The distal and portion 51a of the lever 51 is sandwiched between the shift plate 53 and the bracket 40 by the spring force $F_1$ of the compression spring 20.

Figures 20A, 20B, 20C:
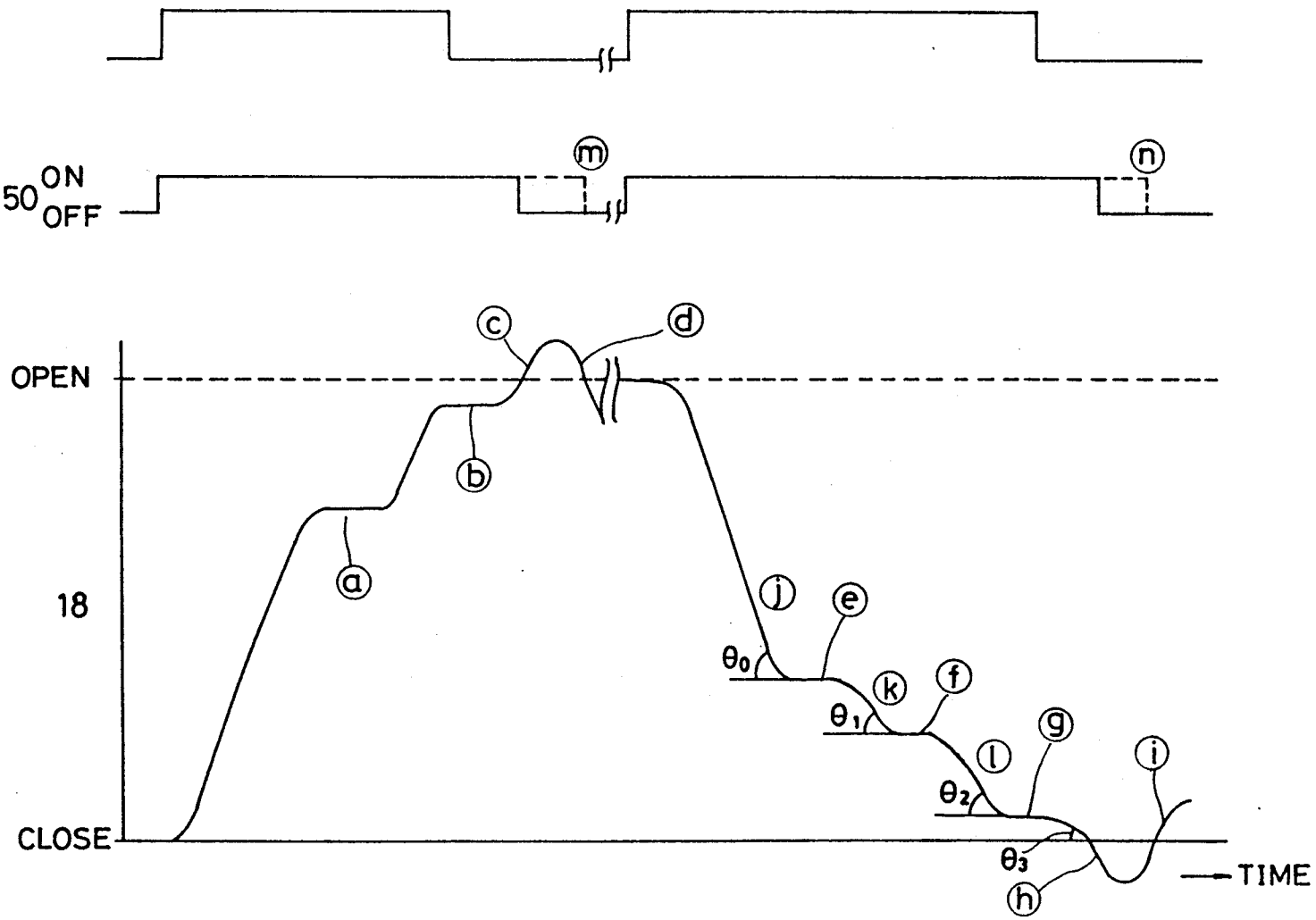
FIG. 20A is a diagram of the operation of the solenoid magnet.
FIG. 20B is a diagram of the operation of the clutch between the bevel gears.
FIG. 20C is a diagram of the operation of the space motor while the bail roller opening and closing operation is performed.

The space motor 18 stops at the time when the space motor 18 opens the bail roller 15 about three quarters of the full amount of opening (refer to a of FIG. 20C). The stop time is for example, 0.05 secs. and is the same as the stop time for b, e, f and g to be described later. By this, the opening operation of the bail roller 15 is stopped temporarily and the inertia force of the bail roller opening and closing mechanism is reduced to zero.

(2) After having stopped, the space motor 18 starts to rotate at the same speed, as it did before stopping and opens the bail roller 15, and then stops once again at a position immediately before the fully open position (b in FIG. 20C). Accordingly, the bail roller 15 stops immediately before it hits against the stopper 63 and is urged in the direction of the fully open position by the torsion spring 60.

The spring force of the torsion spring 60 is transmitted via the connecting rod 43 and the crank 42 to the bevel gear 41, which is thereby urged to rotate in the same direction as the direction of rotation when there is the opening operation for the bail roller.

At this time, the bevel gear 34 on the space motor 18 is being stopped. Because of this, the teeth of the bevel gear 41 are pressed against the teeth of the already stopped bevel gear 34, and a component of reaction on the bevel gear 41 becomes a force $F_2$ for urging the bevel gear 41 itself toward the bracket 40.

The following is a description of the reason for the generation of the force $F_2$ in the bevel gear 41.

Figure 22:
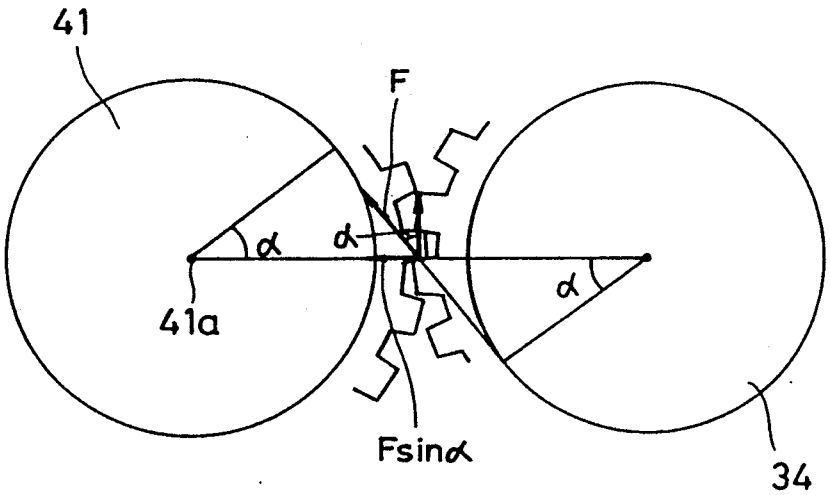

First, as indicated in FIG. 22, the bevel gear 41 is pressed against the already stopped bevel gear 34 and receives the reaction force F. The component $F \cdot \sin \alpha$](where $\alpha$ is the angle of pressure of the bevel gear 41) of this reaction force F acts in the direction whereby the bevel gear 41 is separated from the bevel gear 64. As indicated in FIG. 22, this component $F \cdot \sin \alpha$ has the two components in the direction radial to the bevel gear 41 and in the direction of the thrust.

The component (force) $F \cdot \sin \alpha \cdot \cos \beta$ (where $\beta$ is face angle of the bevel gear 34) acts in the direction of the thrust of the bevel gear 41.

This force $F \cdot \sin \alpha \cdot \cos \beta$ is the previously described force $F_2$.

Accordingly, there occurs a state where a large clamp force which is the sum of the forces $F_1$ and $F_2$ is applied to the shift member 53.

Because of this, even when the solenoid magnet 50 is turned off at a moment of time during the period of time of 0.005 sec, the clutch lever 51 is maintained in the state where it cannot be pulled out from between the shift member 43 and the bracket 40.

(3) Then, the space motor 18 starts to rotate in the direction of opening (c of FIG. 20C). By this, the bail roller 15 comes into contact with the stopper 63 and stops and the bevel gear 41 stops. However, the bevel gear 34 on the space motor 18 rotates further and so in the following moment, the teeth of the bevel gear 34 separates from the teeth of the bevel gear 41. By this, the above described force $F_2$ is cancelled, and the clutch lever 51 is pulled out from between the shift member 53 and the bracket 40 and the bevel gear 41 is thereby shifted to the left in FIG. 21 by the compression coil spring 20 and the engagement of the bevel gear 41 and the bevel gear 34 is disengaged (refer to FIG. 20A).

The bail roller 15 becomes stable in the state where it is lightly pressed against the stopper 63 by the urging force of the torsion spring 60.

(4) The space motor 18 rotates (freely) so as to open further the bail roller 15 from the fully open position thereof, and thereafter rotates in the direction opposite the direction of closing (d in FIG. 20C). By tis, if there is any foreign object between the bail roller 15 and the stopper 63 or if the bale roller 15 stops midway, then the engagement of the bevel gear 41 and the bevel gear 34 is disengaged. This is to say that if there is any foreign object, then the bevel gear 34 stops in the state where the teeth of the bevel gear 34 press against the teeth of the bevel gear 41, the reverse rotation of the space motor 18 causes the contacting surfaces of the bevel gear 41 and the bevel gear 34 to disengage.

By this, the above mentioned force $F_2$ is cancelled and the clutch lever 51 is returned, the bevel gear 41 returns and the engagement of the bevel gear 41 and the bevel gear 34 is disengaged (m of FIG. 20B).

(5) In this manner, when the bail roller 15 becomes fully open, the line feed motor 74 is driven so that a printing paper 100 is loaded. Then, when the loading of the printing paper 100 is completed, the solenoid magnet 50 turns on as indicated in FIG. 20B and the bevel gear 41 and the bevel gear 34 are engaged by the clutch lever 51. Then, the space motor 18 starts to rotate in the direction to close the bail roller 15.

As a result, as indicated in FIG. 19, the crank 42 rotates via the bevel gear 34 and bevel gear 41 and the bail arm 15*b* rotates via the connecting rod 43, and the bail roller 15 moves in the direction of closing.

(6) The space motor 18 stops temporarily at the time when the space motor 18 has closed the bail roller 15 for about two thirds of the amount of the fully closed position (e of FIG. 20C). By this, the closure of the bail roller 15 is stopped temporarily and the inertia force is reduced to zero.

In this embodiment wherein only one end of the bail roller 15 connected to the connecting rod 43, the opposite end of the bail roller 15 that has no connecting rod moves slightly as it is due to the inertia force after the motor 18 is stopped. Accordingly, if the space motor 18 stops suddenly immediately before the position of full closure of bail roller 15, the above opposite end of the bail roller 15 will comes to strike against the platen 11.

Therefore, the temporary stopping of the space motor 18 takes place at a position sufficient distance before the full closure position.

(7) The space motor 18 rotates so as to close the bail roller 15 and then stops once again (f in FIG. 20C) so as to cancel the inertia force. Then, the space motor 18 starts again and stops temporarily at a position immediately before the fully closed position. Accordingly, the bail roller 15 stops at a position before it strikes the platen 11 and is urged in the fully closed position by the torsion spring 60.

As a result, there occurs a state where the teeth of the bevel gear 41 presses against the teeth of the bevel gear 34, which causes the force $F_2$ to generate.

Then, while being stopped, the solenoid magnet 50 is turned off but in this state, the above described force $F_2$ exists and so the return of the clutch lever 51 is restricted, the return of the bevel gear 41 is thereby restricted and the engagement of the bevel gear 41 and the bevel gear 34 is not disengaged.

(8) Following this, the space motor 18 rotate in direction of closing (h in FIG. 20C) and the bail roller 15 strikes the platen 11 and stops.

Since the bail roller 15 starts to move from a state where there is practically no inertia force and further only undergoes a slight movement, until the bail roller 15 reaches the platen 11, the bail roller 15 has a relatively small impact force when it strikes the platen 11 and the paper is not marked even if pressure-sensitive paper is used.

In addition, the inclination angles $\theta_1$, $\theta_2$ and $\theta_3$ in the portions indicated by k, 1 and h in FIG. 20C, are smaller than the inclination angle $\theta$ of the portion indicated by i. This is to say that the rotational speed of the space motor 18 is slower in the latter half of closure of the bail roller 15 than it is for the former half.

Because of this, at the position immediately before the bail roller 15 strikes the platen 11, the speed of movement of the bail roller 15 becomes slow and the inertia force of the bail roller 15 is limited. By this, the adverse influence when the bail roller 15 strikes the platen 11 is alleviated.

In addition, when the bail roller 15 strikes the platen 11, the bevel gear 41 stops. However, the bevel gear 34 on the s motor 18 rotates further and so in the following movement, the teeth of the bevel gear 41 and bevel gear 34 are separated.

By this, the above described force $F_2$ is nullified, the clutch lever 51 returns, the bevel gear 41 returns and the bevel gear 41 and the bevel gear 34 are disengaged.

The bail roller 15 becomes stable in the state where it is lightly pressed against the platen 11 by the urging force of the torsion spring 60.

(9) The space motor 18 rotates (freely) so as to close further the bail roller 15 from the fully closed position thereof, and thereafter rotates in the direction opposite the direction of opening (i in FIG. 20C). By this, if there is any foreign object between the bail roller 15 and the platen 11 or if the bail roller 15 stops midway, then the engagement of the bevel gear 41 and the bevel gear 34 is disengaged. This is to say that in the same manner as for when the bail roller 15 is open, if there is any foreign object, then the bevel gear 34 stops in the state where the teeth of the bevel gear 34 press against the teeth of the bevel gear 41. Accordingly, the reverse rotation of the space motor 18 causes the contacting surfaces of the bevel gear 41 and the bevel gear 34 to disengage.

By this, the above mentioned force $F_2$ is cancelled and the clutch lever 51 is returned, the bevel gear 41 returns and the engagement of the bevel gear 41 and the bevel gear 34 is disengaged (n of FIG. 20B).

The closing operation of the bail roller 15 is completed in the above described manner.

The number of times that the bail roller 15 stops in the closing operation of the bail roller 15 can be determined depending upon the inertia force of the bail roller 15. In the present invention, the space motor 18 stops temporarily at least once in the operation between the fully open state and the fully closed state.

Figure 24:
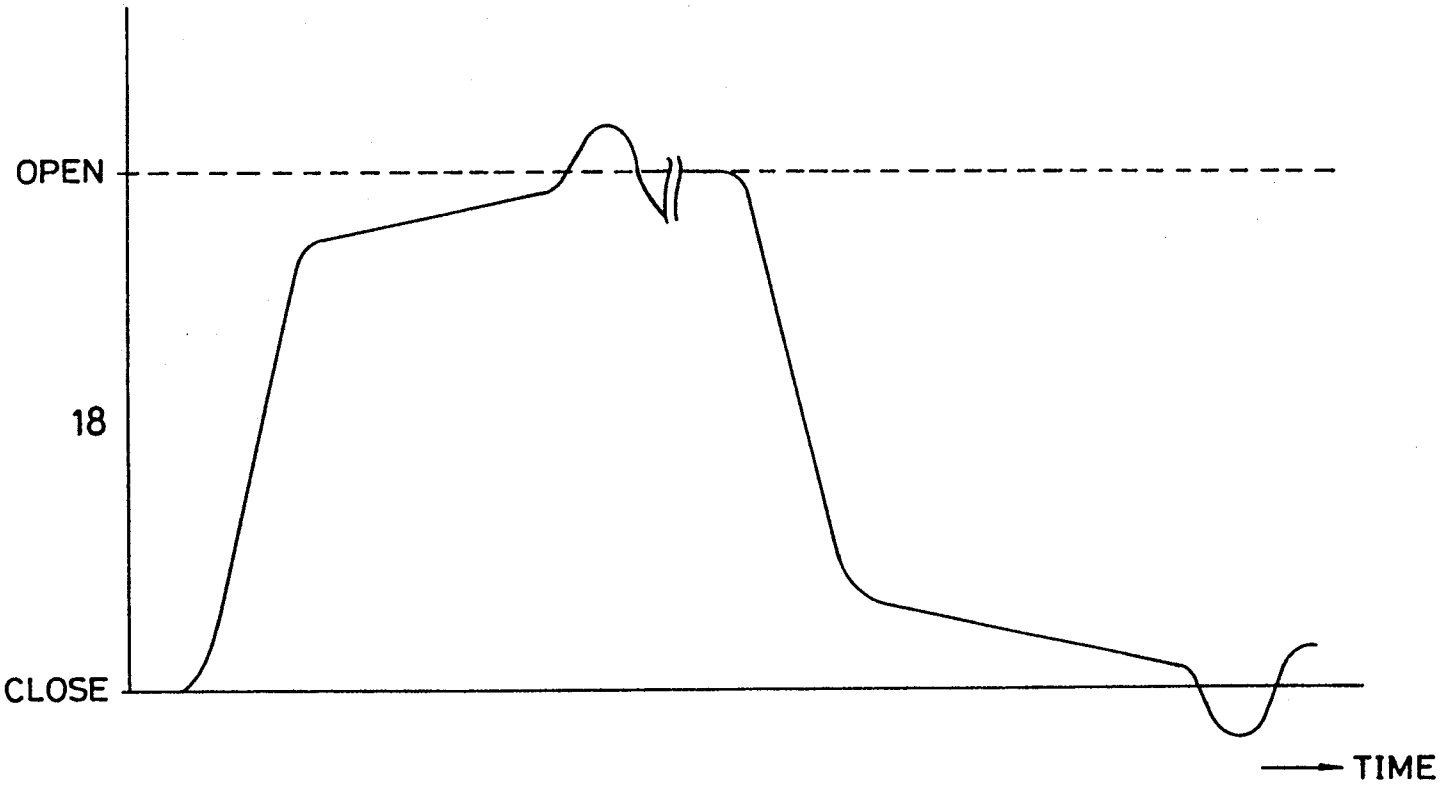
FIG. 24 is a diagram describing the operation of the space motor for another embodiment, for when there is bail roller opening and closing operation.

FIG. 24 indicates another embodiment for controlling the space motor 18.

For both the opening and closing operation, control is divided into the first half section and the second half section. With the first half section, the space motor 18 is controlled to rotate at normal speed, and with the second half section, the space motor 18 is controlled to rotate at a speed slower than the normal speed.

Figure 25:
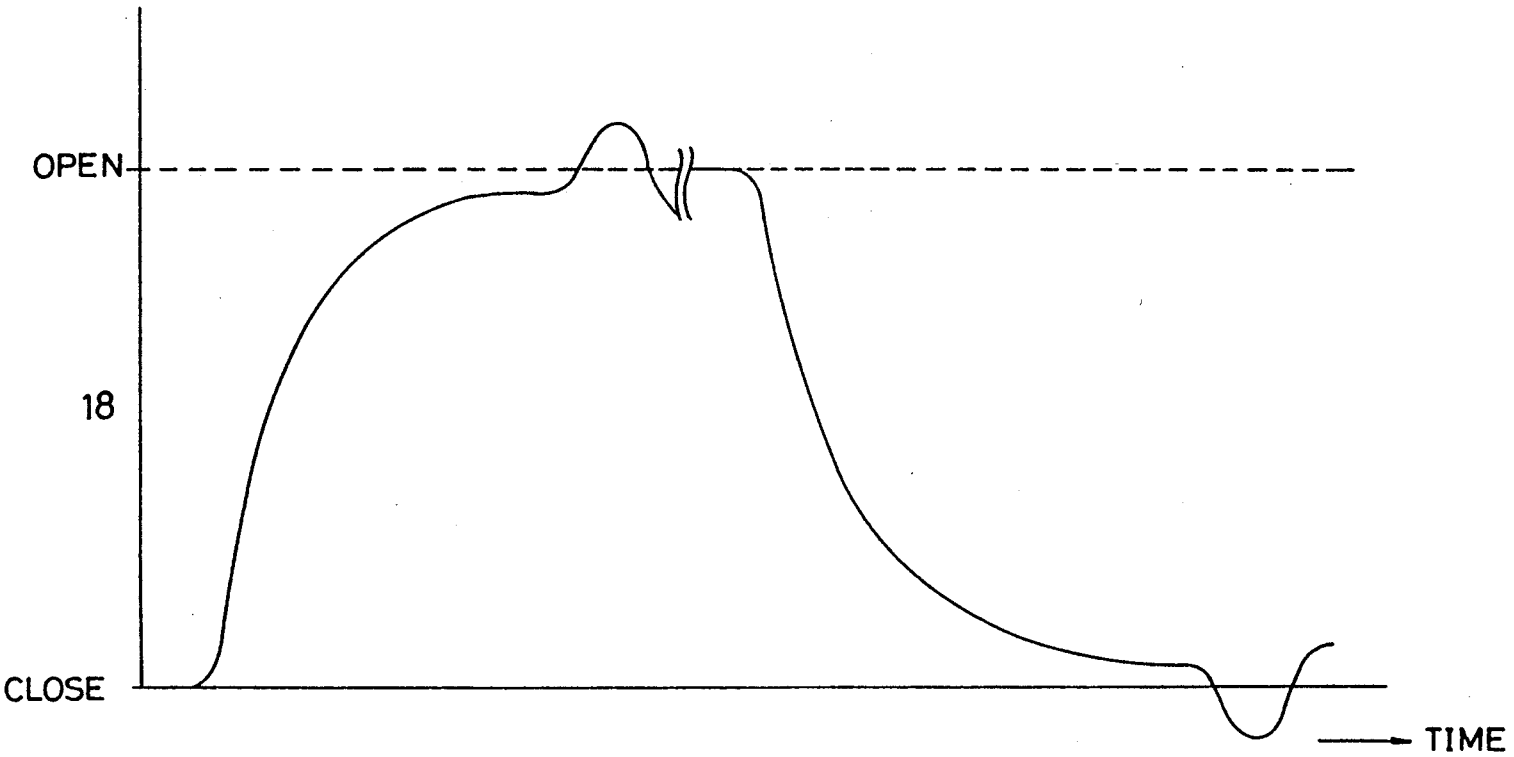
FIG. 25 is a diagram describing the operation of the space motor for still another embodiment, for when there is bail roller opening and closing operation.

FIG. 25 indicates still another embodiment for controlling the space motor 18.

Control is made so that the rotational speed of the space motor 18 becomes gradually slower for both the opening and closing operation of the bail roller 15.

Moreover, the operation for disengaging the engagement of the bevel gear 41 and the bevel gear 34 when the bail roller 15 is either fully open or fully closed is the same as for the previously described embodiment.

This control is performed by storing data for the bail roller opening and closing operation beforehand in the ROM 73 indicated in FIG. 18.

In the above described seventh embodiment, the drive force for the bail roller opening and closing is not limited to the space motor 18, but can be the line feed motor 74, or another motor used exclusively for opening and closing the bail roller.

Furthermore, the present invention is not limited to these embodiments, but various variations and modifications may be made without departing from the scope of the present invention.

What is claimed is:

1. A printer having a bail roller opening and closing mechanism comprising:

a platen;

a printing head movable along said platen;

printing head moving means including a space motor for moving said printing head along said platen;

a bail roller for pressing a printing medium against said platen;

bail roller opening and closing means for moving said bail roller between a closed position where it is in contact with said platen, and an open position where it is separated from said platen; and a clutch means driven by said space motor and having a first normal mode transmitting drive from said space motor to said printing head moving means and a second mode disconnecting said space motor from said transmitting drive to said printing head moving means and connecting said space motor for transmitting drive to said bail roller opening and closing means when said bail roller is to be displaced, so that said space motor selectively drives said printing head moving means in said first mode and said bail roller opening and closing means in said second mode;

said bail roller opening and closing means comprising:

a rotating member rotationally driven by said space motor through said clutch means in said second mode;

a transmission member causing said bail roller to undergo displacement due to displacement of said transmission member itself and displaced due to manual displacement of said bail roller; and a bidirectional motion transmission mechanism for transmitting bidirectionally motion between said rotating member and said transmission member such that the motion of said rotating member is transmitted to said transmission member and the motion of said transmission member is transmitted to said rotating member.

2. The printer as claimed in claim 1, wherein said rotating member is a crank;

said transmission member is a connecting rod; and said bidirectional motion transmission mechanism is a mechanism which links said crank and one end of said connecting rod.

3. The printer as claimed in claim 1, wherein said rotating member is a timing gear;

said transmission member is a timing belt; and said bidirectional motion transmission mechanism is a mechanism in which said timing belt is engaged around said timing gear.

4. The printer as claimed in claim 1, wherein said rotating member is a first gear;

said transmission member is a second gear; and said bidirectional motion transmission mechanism is a mechanism in which said first gear is in meshed engagement with said second gear.

5. The printer as claimed in claim 1, wherein said transmission member is an arm member rotatably supported at one end thereof, and having an elongated slot at midway thereof; and said bidirectional motion transmission mechanism is a mechanism in which a pin on said rotating member engages with said slot.

6. The printer as claimed in claim 1, wherein said rotating member is a pinion;

said transmission member is a member having a rack at one end; and said bidirectional motion transmission mechanism is a mechanism in which said rack engages said with said pinion.

7. A printer as claimed in claim 1, further having a control means for controlling said space motor so that during said operation of said bail roller moving said bail roller to said closed position from said open position, said space motor stops temporarily.

8. A printer as claimed in claim 1, further having a control means for controlling said space motor so that at a position in the vicinity of completion of moving said bail roller to said closed position from said open position, the rotational speed of said space motor is slowed.

9. A printer as claimed in claim 1, having a motor drive control means for controlling said space motor so that when said bail roller is displaced from said open position to said closed position, the rotational speed of said space motor is gradually slowed.

10. A printer as claimed in claim 1, further having a coupling connectable and separable along a transmission path for transmitting a drive force of said space motor to said bail roller opening and closing means;

a solenoid magnet for placing said coupling in a connected state when said solenoid magnet is energized, and for placing said coupling in a separated state when said solenoid magnet is deenergized; and a control means for stopping said motor and for deenergizing said solenoid magnet at a position immediately before said bail roller is operated to said closed position, and temporarily rotate said motor in said bail roller closing direction.

11. A printer as claimed in claim 1, further having a coupling connectable and separable along a transmission path for transmitting a drive force of said space motor to said bail roller opening and closing means;

a solenoid magnet for connecting said coupling when said solenoid magnet is energized, and for decoupling said coupling when said solenoid magnet is deenergized; and means for stopping said space motor and for deenergizing said solenoid magnet at a position immediately before said bail roller is moved to said closed position, and then temporarily rotate said space motor in said bail roller closing direction and then temporarily in the opposite direction.

* * * * *